US005508471A

United States Patent [19]

Shimada

[11] Patent Number: 5,508,471

[45] Date of Patent: Apr. 16, 1996

[54] AUTOMATIC PERFORMANCE APPARATUS FOR AN ELECTRONIC MUSICAL INSTRUMENT

[75] Inventor: Yoshihisa Shimada, Hamamatsu, Japan

[73] Assignee: Kabushiki Kaisha Kawai Gakki Seisakusho, Shizuoka, Japan

[21] Appl. No.: 250,690

[22] Filed: May 27, 1994

[30] Foreign Application Priority Data

May 31, 1993 [JP] Japan ..... 5-152725

[51] Int. Cl.[6] ..... G10H 1/36; G10H 1/40

[52] U.S. Cl. ..... 84/610; 84/611; 84/634; 84/635; 84/DIG. 12

[58] Field of Search ..... 84/609–614, 634–638, 84/DIG. 12, DIG. 22

[56] References Cited

U.S. PATENT DOCUMENTS 5,164,531 1/1992 Imaizumi et al. .

*Primary Examiner*—Stanley J. Witkowski

[57] ABSTRACT

An automatic performance apparatus for an electronic musical instrument, which includes a change-instructing device for instructing alteration between first performance pattern and second performance pattern; a first controller for, when the readout device is reading out none of first to fourth automatic performance data at time alteration of a performance pattern is instructed by the change-instructing device, selecting the first automatic performance data or the second automatic performance data in accordance with an instruction of the change-instructing device, and causing a readout device to read out the selected automatic performance data in accordance with an instruction of a start-instructing device; and a second controller for causing the readout device, when reading out the first automatic performance data at a time alteration of a performance pattern is instructed by the change-instructing device, to stop reading out the first automatic performance data, read out the third automatic performance data and then read out the second automatic performance data, or causing the readout device, when reading out the second automatic performance data at a time alteration of a performance pattern is instructed by the change-instructing device, to stop reading out the second automatic performance data, read out the fourth automatic performance data and then read out the first automatic performance data, in accordance with an instruction from the change-instructing devices.

3 Claims, 10 Drawing Sheets

RHYTHM START PROCESS ROUNTINE

INTRO/ENDING START PROCESS ROUTINE

AUTOMATIC PERFORMANCE APPARATUS FOR AN ELECTRONIC MUSICAL INSTRUMENT

BACKGROUND OF THE INVENTION AND RELATED ART STATEMENT

The present invention relates to an automatic performance apparatus for an electronic musical instrument, which can alter a performance pattern in an automatic performance in accordance with the instruction by a player.

Recent electronic musical instruments, such as an electronic keyboard, electronic organ and electronic piano and the like, are equipped with an automatic performance apparatus which executes an automatic performance like an automatic rhythm accompaniment or automatic chord accompaniment. The use of this automatic performance apparatus permits a player to play melodies or the like in accordance with an accompaniment that is automatically produced by the automatic performance apparatus.

This automatic performance apparatus repeatedly reads out automatic performance data corresponding to a selected performance pattern from a memory and supplies the data to a tone generator. The tone generator generates a tone signal based on this automatic performance data and sends the tone signal to a loudspeaker. The loudspeaker then generates an accompaniment accordingly.

The automatic performance apparatus has a function to change a performance pattern at the beginning, ending or middle of music, besides the above mentioned function of generating an accompaniment which is formed by repeating a given performance pattern. The former function helps presenting a varied automatic performance so that a modulated accompaniment can be produced.

To accomplish the performance-pattern altering function, the automatic performance apparatus has a memory where one to several bars of automatic performance data corresponding to each of the performance patterns namely "introduction" (hereinafter called "intro"), "basic", "fill-in" and "ending", are stored. The automatic performance data is of the same format as the one used in an embodiment of the present invention and is exemplified in FIG. 3. The details will be given later.

The player selects "intro", "basic" "fill-in" or "ending" using an operating element provided on, for example, a control panel. Through this selection, the electronic musical instrument can perform an automatic accompaniment with the desired performance pattern.

"Basic" is a basic performance pattern of rhythms. Normally, when a automatic performance start switch provided on, for example, the control panel is depressed, an automatic accompaniment with this basic performance pattern (hereinafter called "basic performance") starts. This basic performance continues until an ending switch, which will be discussed later, is depressed.

"Intro" is a performance pattern which is used to execute an automatic performance having a predetermined characteristic before the basic performance. When an intro switch provided on, for example, the control panel, is depressed, an automatic performance with this "intro" performance pattern (hereinafter called "intro performance") is executed for a given number of bars (e.g., one bar), after which the basic performance takes place.

"Ending" is a performance pattern which is used to execute an automatic performance having a predetermined characteristic to end the basic performance. When the ending switch, provided on, for example, the control panel, is depressed during the basic performance, the basic performance stops and an automatic performance with this ending performance pattern (hereinafter called "ending performance") is executed for a given number of bars (e.g., one bar), after which the automatic performance is terminated.

"Fill-in" is a performance pattern which is used to execute an automatic performance having a predetermined characteristic during the basic performance. When a fill-in switch provided on, for example, the control panel, is depressed during the basic performance, the basic performance which has been performed at that point is temporarily interrupted, and a fill-in performance is executed for a given number of bars (e.g., one bar), after which the basic performance is resumed. This fill-in is used to modulate an automatic performance.

An automatic performance apparatus having performance patterns for two types of "basics " having the same rhythm (hereinafter called "basic 1" and "basic 2") has also been developed recently. The performance pattern of basic 1 is used for the normal automatic performance, for example. The performance pattern of basic 2 is used for a loud automatic performance containing a variety of high-volume timbres, such as the one that is played at the climax (hereinafter called "automatic performance for climax").

According to this automatic performance apparatus, when, for example, a variation switch provided on the control panel is operated, an automatic performance with the performance pattern of basic 1 (hereinafter called "basic 1 performance") during an automatic performance is changed to an automatic performance with the performance pattern of basic 2 (hereinafter called "basic 2 performance"), or vice versa. The player can therefore accomplish the transition from the normal automatic performance with the performance pattern of basic 1 to the automatic performance for climax of the same rhythm with the performance pattern of basic 2, or vice versa by operating the variation switch as needed.

This automatic performance apparatus however has a shortcoming that when the variation switch is operated, the basic 1 performance is changed to the basic 2 performance or vice versa abruptly, so that the transition is not aurally smooth, causing the player to feel awkward. With the conventional automatic performance apparatuses, therefore, it is difficult to gradually reach the climax as music progresses. Further, many control switches are needed for controlling each automatic performance of intro, basic, fill-in and ending. Therefore, an automatic performance apparatus provided with fewer control switches is required.

OBJECT AND SUMMARY OF THE INVENTION

It is therefore an object of the present invention to provide an automatic performance apparatus for an electronic musical instrument with less control switches, which can smoothly shift from a predetermined performance pattern to another performance pattern without causing a player to feel awkward.

According to the present invention, there is provided an automatic performance apparatus for an electronic musical instrument, which comprises storage means for storing first automatic performance data for an automatic performance with a first performance pattern, second automatic performance data for an automatic performance with a second performance pattern, third automatic performance data for an automatic performance with a third performance pattern, and fourth automatic performance data for an automatic performance with a fourth performance pattern; readout means for reading out said first to fourth automatic performance data from said storage means; tone generating means for generating musical tones based on said first to fourth automatic performance data read out by said readout means; start-instructing means for giving an instruction to start reading out said first or said second automatic performance data; change-instructing means for instructing alteration between the first performance pattern and the second performance pattern; first control means for, when said readout means is reading out none of said first to fourth automatic performance data at time alteration of a performance pattern is instructed by said change-instructing means, selecting said first automatic performance data or said second automatic performance data in accordance with an instruction of said change-instructing means, and causing said readout means to read out said selected automatic performance data in accordance with an instruction of said start-instructing means; and second control means for causing said readout means, when reading out said first automatic performance data at a time alteration of a performance pattern is instructed by said change-instructing means, to stop reading out said first automatic performance data, read out said third automatic performance data and then read out said second automatic performance data, or causing said readout means, when reading out said second automatic performance data at a time alteration of a performance pattern is instructed by said change-instructing means, to stop reading out said second automatic performance data, read out said fourth automatic performance data and then read out said first automatic performance data, in accordance with an instruction from said change-instructing means.

The automatic performance apparatus according to the present invention is provided with two types of automatic performance data, first automatic performance data and second automatic performance data, for performing automatic performances with two different performance patterns having the same rhythm, for example, as well as with third automatic performance data for performing an automatic performance with a third performance pattern at the time of changing the first performance pattern to the second performance pattern and fourth automatic performance data for performing an automatic performance with a fourth performance pattern at the time of changing the second performance pattern to the first performance pattern.

When a performance-pattern change instruction is given by the change-instructing means during the execution of the automatic performance with the first performance pattern while reading out the first automatic performance data from the storage means, readout of the first automatic performance data is stopped, readout of the third automatic performance data is started, and readout of the second automatic performance data is started after the readout of the third automatic performance data is completed. As the tone generating means generates musical tones based on the first to fourth automatic performance data read out from the storage means, the performance patterns change in order from the first performance pattern, to (what is instructed by the change-instructing means), to the third performance pattern, and then to the second performance pattern.

Likewise, when a performance-pattern change instruction is given by the change-instructing means during the execution of the automatic performance with the second performance pattern while reading out the second automatic performance data from the storage means, readout of the second automatic performance data is stopped, readout of the fourth automatic performance data is started and readout of the first automatic performance data is started after the readout of the fourth automatic performance data is completed. As the tone generating means generates musical tones based on the first to fourth automatic performance data read out from the storage means, the performance patterns change in order from the second performance pattern, to (what is instructed by the change-instructing means), to the fourth performance pattern, and then to the first performance pattern.

When an instruction is given by the change-instructing means, therefore, the first performance pattern is shifted to the second performance pattern via the third performance pattern or the second performance pattern is shifted to the first performance pattern via the fourth performance pattern. If the third or fourth performance pattern is prepared in such a way as to ensure aurally smooth transition between the first performance pattern and the second performance pattern, the transition between the first performance pattern and the second performance pattern can be accomplished without awkwardness.

The change-instructing means serves to instruct whether the first performance pattern or second performance pattern should be used to execute an automatic performance when an automatic performance starts while an automatic performance is not performed, as well as to instruct the transition from the first performance pattern to the second performance pattern or vice versa. The shared use of the change-instructing means in such different instructions can reduce the number of required control switches.

According to a first preferable embodiment of the present invention, the storage means comprises a read only memory.

According to a second preferable embodiment of the present invention, the readout means reads out the first or second automatic performance data repeatedly and reads out the third or fourth automatic performance data once. When a automatic performance change instruction is given by the change-instructing means while the automatic performance with the first performance pattern continues, the automatic performance with the third performance pattern is executed just once (e.g., for one bar) after which the automatic performance with the second performance pattern takes place. Likewise, when a automatic performance change instruction is given by the change-instructing means while the automatic performance with, the second performance pattern continues, the automatic performance with the fourth performance pattern is executed just once (e.g., for one bar) after which the automatic performance with the first performance pattern takes place.

According to a third preferable embodiment of the present invention, automatic performance data for an automatic performance of a performance pattern, which provides a predetermined aural feeling, may be used as the first automatic performance data, and automatic performance data for an automatic performance of a performance pattern, which provides another aural feeling, may be used as the second automatic performance data. Further, automatic performance data for an automatic performance of a performance pattern, which provides an aural feeling of transition from the predetermined aural feeling to said another aural feeling, may be used as the third automatic performance data, and automatic performance data for an automatic performance of a performance pattern, which provides an aural feeling of transition from said another aural feeling to the normal aural feeling, may be used as the fourth automatic performance data.

If the first to fourth performance patterns are prepared in such a way that the first performance pattern is for a normal automatic performance, the second performance pattern is for an automatic performance for climax, the third performance pattern is for an automatic performance which ensures a gradual transition from the normal automatic performance to the climax, and the fourth performance pattern is for an automatic performance which ensures a gradual transition from the automatic performance for climax to the normal automatic performance, the transition between the normal automatic performance and the automatic performance for climax becomes smooth, thus eliminating the awkward aural feeling.

DESCRIPTION OF THE PREFERRED EMBODIMENT

An automatic performance apparatus for an electronic musical instrument according to one embodiment of the present invention will now be described referring to the accompanying drawings.

Figure 1:
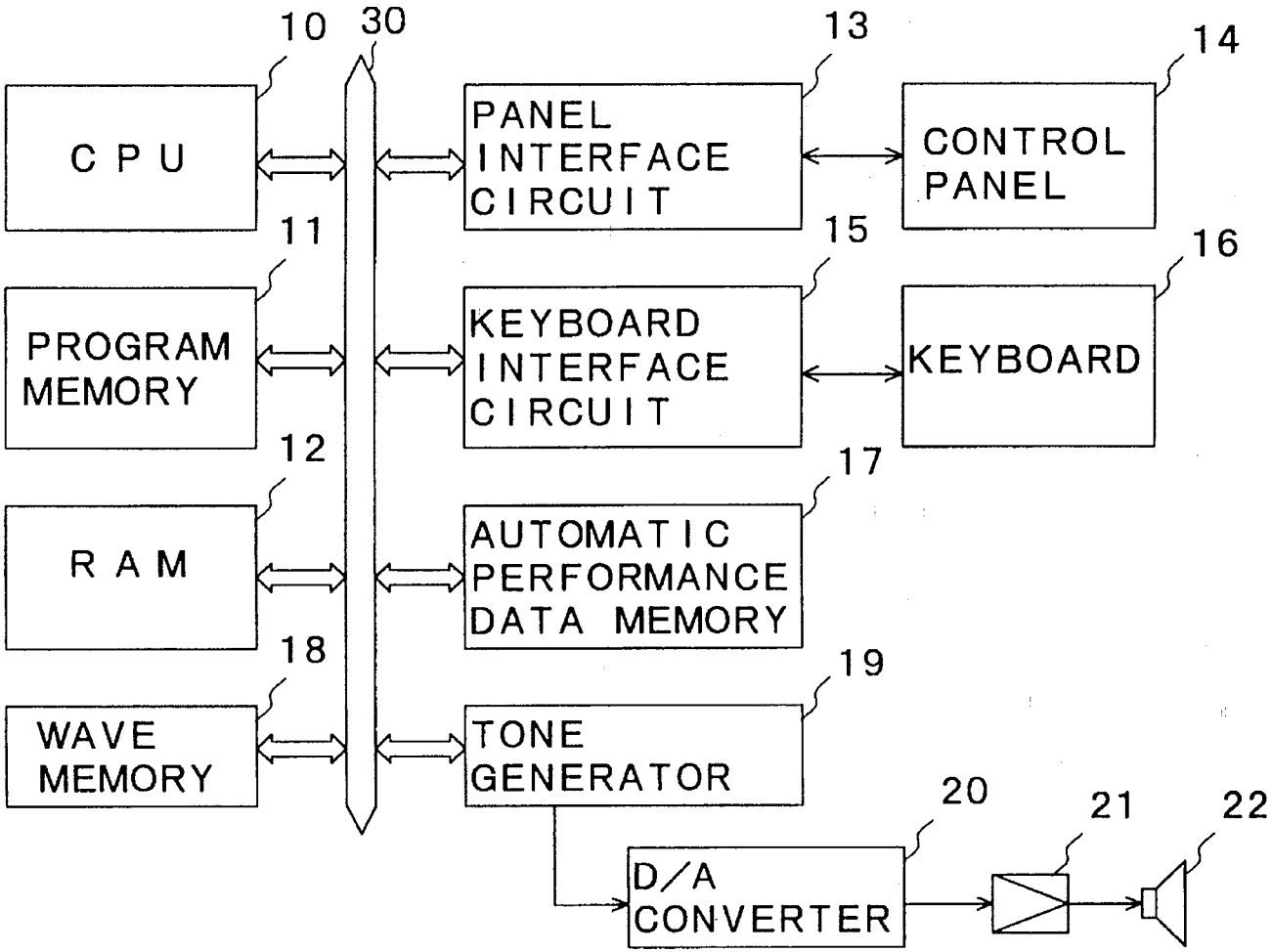
FIG. 1 is a block diagram showing the structure of an automatic performance apparatus for an electronic musical instrument according to one embodiment of the present invention.

FIG. 1 presents a block diagram showing the schematic structure of an electronic musical instrument for which the automatic performance apparatus according to the embodiment of the present invention is adapted. The automatic performance apparatus of the present invention is incorporated in the electronic musical instrument shown in FIG. 1. The automatic performance apparatus of the present invention and the electronic musical instrument share most of the hardware, and the function of the automatic performance apparatus is accomplished essentially by the control of a central processing unit (CPU) 10.

The automatic performance apparatus of the present invention comprises storage means, readout means, tone generating means, start-instructing means, change-instructing means, first control means and second control means. In one embodiment of the present invention, the storage means is automatic performance data memory 17; the readout means is the CPU 10; and the tone generating means is the CPU 10, a wave memory 18, a tone generator 19, a D/A converter 20, an amplifier 21 and a loudspeaker 22. In this embodiment of the present invention, the start-instructing means is a start/stop switch 141 (see FIG. 2) provided on a control panel 14; the change-instructing means is a variation switch 142 (see FIG. 2) provided on the control panel 14; the first and second control means are the CPU 10.

As shown in FIG. 1, the electronic musical instrument to which the automatic performance apparatus of the present invention is applied includes the CPU 10, a program memory 11, a random access memory (RAM) 12, a panel interface circuit 13, a keyboard interface circuit 15, the automatic performance data memory 17, the wave memory 18 and the tone generator 19, which are mutually connected by a system bus 30. The system bus 30 comprises an address bus, a data bus and a control signal bus, and is used to ensure communication between the components listed above.

In one embodiment, the CPU 10 serves as the readout means, part of the tone generating means and the first and second control means of the automatic performance apparatus of the present invention. The CPU 10 controls the individual sections of the electronic musical instrument in accordance with control programs stored in the program memory 11. For example, the CPU 10 executes a tone-ON process or a tone-OFF process according to the operation of a keyboard 16. The CPU 10 also performs various processes according to the operation of the control panel 14, such as a timbre changing process and a rhythm changing process. In the timbre changing process, the timbre number which is selected by a user is stored in a predetermined area in the RAM 12. In the rhythm changing process, the rhythm number which is selected by a user is stored in a predetermined area in the RAM 12.

Stored in the program memory 11 are the aforementioned control programs for the CPU 10 and various types of fixed data the CPU 10 uses in various processes. This program memory 11 also holds timbre parameters for generating musical tones with predetermined timbres. The timbre parameters are provided in association with a plurality of timbres and ranges. Each timbre parameter includes a waveform address, frequency data, envelope data, a filter coefficient and the like.

The RAM 12 temporarily stores various types of data that are used when the CPU 10 executes the control programs. The RAM 12 has various areas, such as a register, a counter and a flag, defined therein, to control the electronic musical instrument.

The control panel 14 is connected to the panel interface circuit 13. That is, the control panel 14 is connected via the panel interface circuit 13 and system bus 30 to the CPU 10.

Figure 2:
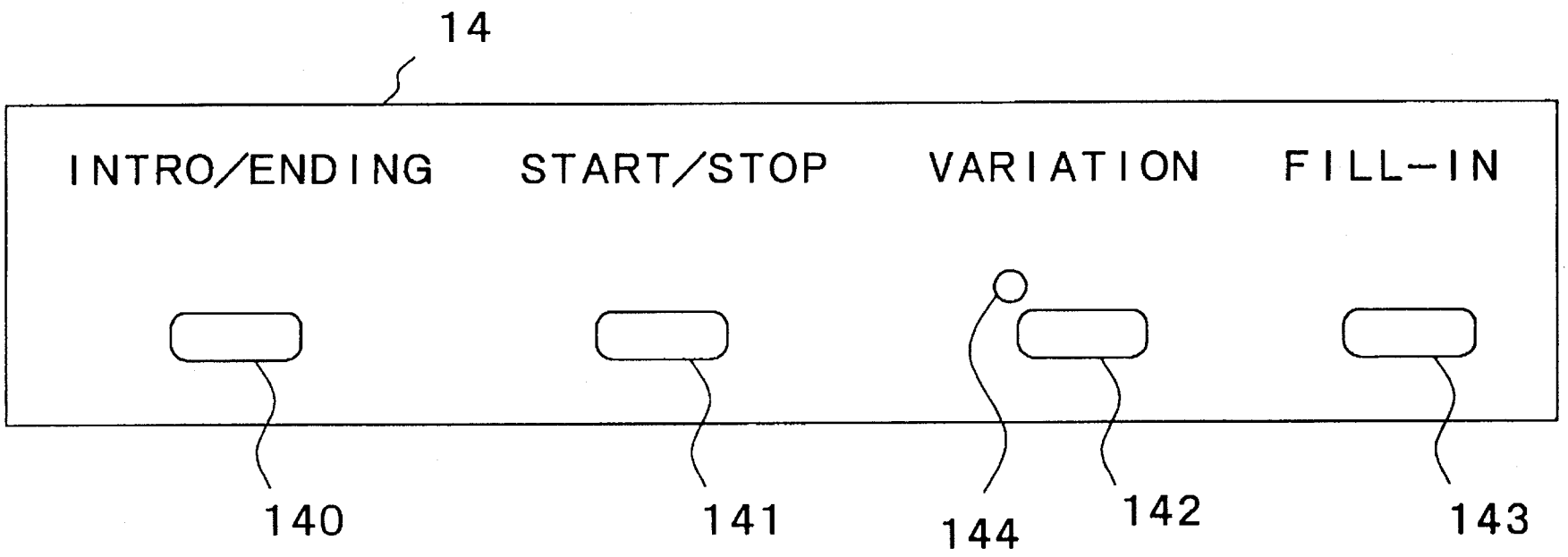
FIG. 2 is a diagram showing one example of a control panel of an electronic musical instrument for which the automatic performance apparatus of the present invention is adapted.

The control panel 14 has an intro/ending switch 140, the start/stop switch 141, the variation switch 142, a fill-in switch 143 and an indicator 144, as shown in FIG. 2. Although the control panel 14 further includes other various switches, such as a timbre selecting switch, a rhythm selecting switch, a volume control switch and an effect selecting switch, an LED (Light Emitting Diode) indicator, LCD (Liquid Crystal Display) indicator and a numerical input device, those elements do not directly relate to the present invention and are thus omitted from FIG. 2.

The intro/ending switch 140 is used to start the intro performance or the ending performance. When the intro/ending switch 140 is depressed while an automatic performance is not performed, the intro performance starts. When the intro performance for a predetermined number of bars (e.g., one bar) is completed, the performance is shifted to a basic 1 performance. When the intro/ending switch 140 is depressed while the basic 1 performance or basic 2 is performed, the basic 1 performance or basic 2 performance stops after which the ending performance takes place. When the ending performance for a predetermined number of bars (e.g., one bar) is completed, the automatic performance is stopped.

The start/stop switch 141 is used to start or stop an automatic performance. When the start/stop switch 141 is depressed while an automatic performance is not performed, the basic 1 or basic 2 performance starts. The state of the variation switch 142 designates which of the basic 1 performance and the basic 2 performance starts. When the start/stop switch 141 is depressed while an automatic performance is performed, the automatic performance is stopped.

The fill-in switch 143 is used to execute an automatic performance with a performance pattern for fill-in 2 (hereinafter called "fill-in 2 performance") during the execution of the basic 1 performance or to execute an automatic performance with a performance pattern for fill-in 1 (hereinafter called "fill-in 1 performance") during the execution of the basic 2 performance. When the fill-in switch 143 is depressed during the execution of the basic 1 performance, the basic 1 performance is temporarily interrupted, the fill-in 2 performance is performed from the point of the depression of the fill-in switch 143 to the end of the bar to which the switch depressing point belongs, and then the basic 1 performance is resumed. Likewise, when the fill-in switch 143 is depressed during the execution of the basic 2 performance, the basic 2 performance is temporarily interrupted, the fill-in 1 performance is performed from the point of the depression of the switch 143 to the end of the bar to which the switch depressing point belongs, and then the basic 2 performance is resumed.

The variation switch 142 is used to instruct the changing between the basic 1 performance and the basic 2 performance. When the variation switch 142 is depressed during the execution of the basic 1 performance, the basic 1 performance is stopped, the fill-in 1 performance is performed from the point of the depression of the switch 142 to the end of the bar to which the switch depressing point belongs, and then the basic 2 performance takes place. In other words, the performance patterns are changed in order from "basic 1", to "fill-in 1" and then to "basic 2." When the variation switch 142 is depressed during the execution of the basic 2 performance, the basic 2 performance is stopped, the fill-in 2 performance is performed from the point of the depression of the switch 142 to the end of the bar to which the switch depressing point belongs, and then the basic 1 performance takes place. In other words, the performance patterns are changed in order from "basic 2", to "fill-in 2" and then to "basic 1." When the variation switch 142 is depressed while no automatic performance is in progress, one of the basic 1 performance and the basic 2 performance is selected. The status of the selection is displayed on the indicator 144.

The indicator 144 indicates the status of the variation switch 142. For example, the indicator 144 is turned off when the depression of the variation switch 142 sets the state of the basic 1 performance, and is turned on when the switch 142 sets the state of the basic 2 performance. The indications may be reversed. The indicator 144 may be an LED.

The panel interface circuit 13 controls data exchange between the control panel 14 and the CPU 10. The CPU 10 receives data from the control panel 14 in the following manner. First, the panel interface circuit 13 sends a scan signal to the control panel 14. In response to this scan signal, the control panel 14 returns a signal indicating the ON/OFF status of each switch to the panel interface circuit 13. The panel interface circuit 13 produces panel data including a sequence of bits indicating the ON/OFF status of the individual switches based on the received signal from the control panel 14, and sends the panel data to the CPU 10.

The CPU 10 sends data to the control panel 14 in the following manner. First, the CPU 10 sends data to the panel interface circuit 13. The panel interface circuit 13 processes the received data as needed, and sends it to the control panel 14. Accordingly, the control of the ON/OFF of the indicator 144, for example, is executed.

Connected to the keyboard interface circuit 15 is the keyboard 16, which has a plurality of keys to specify intervals. The keyboard 16 may be of a 2-contact type in which each of the keys has two key switches that are closed or opened in responsive to the depression or release of that key, so that a key touch can be detected by scanning the status of the individual key switches. The keyboard 16 is connected via the keyboard interface circuit 15 and system bus 30 to the CPU 10.

The keyboard interface circuit 15 controls data exchange between the keyboard 16 and the CPU 10. More specifically, the keyboard interface circuit 15 produces key data indicating the ON/OFF status of each key and velocity data indicating the strength of the key depression according to the operation of the keyboard 16, and sends the key data and the velocity data to the CPU 10. The CPU 10 receives data from the keyboard 16 in the following manner. First, the keyboard interface circuit 15 sends a scan signal to the keyboard 16. In response to the scan signal, the keyboard 16 returns data, which includes a sequence of bits indicating the ON/OFF status of the individual key switches to the keyboard interface circuit 15.

The keyboard interface circuit 15 produces key data indicating the ON/OFF status of each key and velocity data indicating the strength of key depression from the received sequence of bits indicating the ON/OFF statuses of the individual key switches, and sends those data to the CPU 10. The CPU 10 executes a tone-ON process or tone-OFF process based on those data. The details will be given later.

Figure 3:
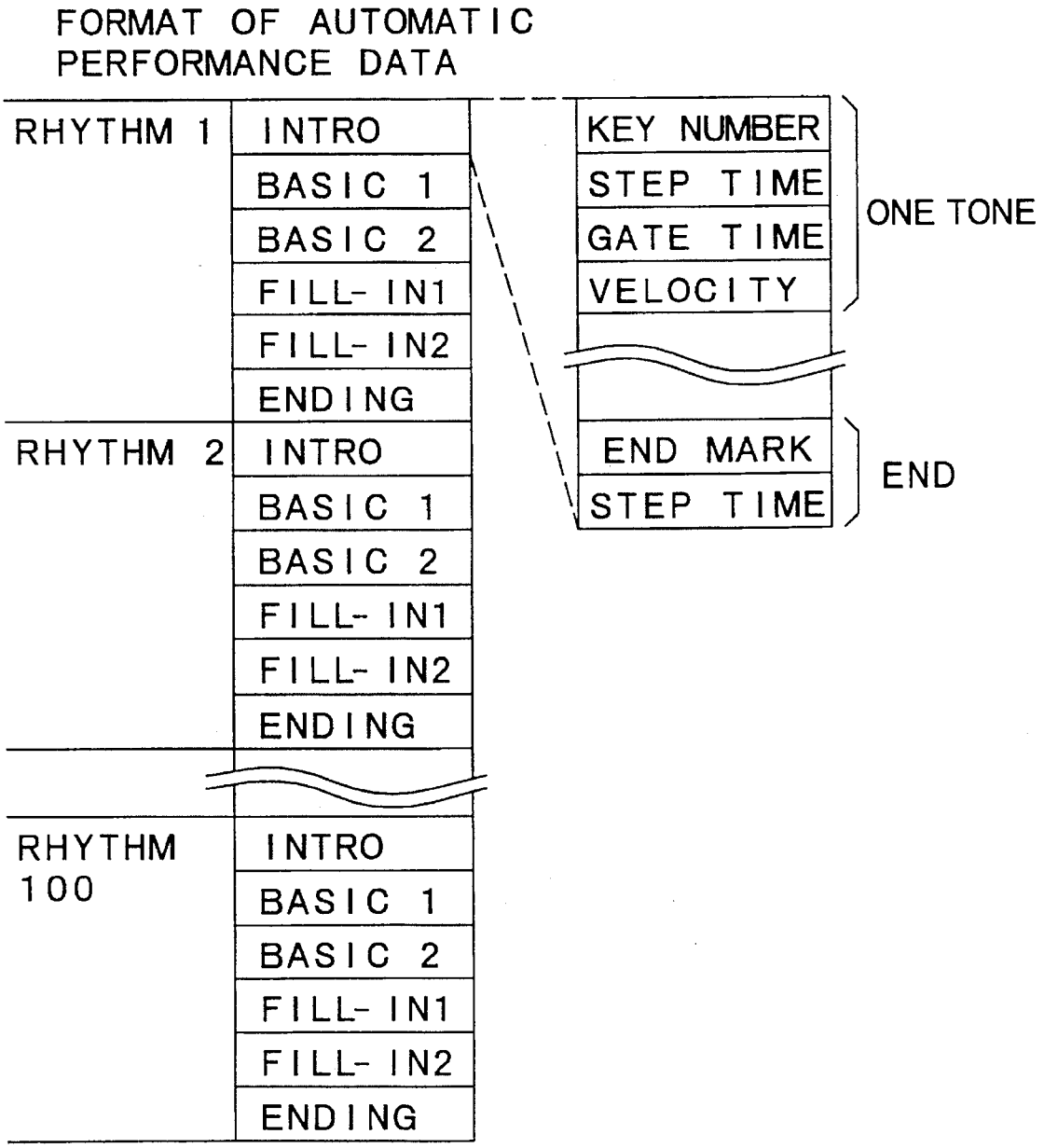
FIG. 3 is a diagram exemplifying the format of automatic performance data which is used by the automatic performance apparatus of the present invention.

The automatic performance data memory 17 may be a ROM (Read Only Memory). As shown in FIG. 3, for each rhythm, the automatic performance data memory 17 stores one set of automatic performance data corresponding to six types of performance patterns for the intro, basic 1, basic 2, fill-in 1, fill-in 2 and ending. FIG. 3 shows a case where automatic performance data for 100 sets of performance patterns are stored in the automatic performance data memory 17.

The automatic performance data corresponding to each performance pattern has a plurality of 4-byte information including a key number, a step type, a gate time and a velocity, each of one byte, as shown in FIG. 3. Each 4-byte information will be hereinafter called "unit automatic performance data." The unit automatic performance data is used to generate a single tone.

The key number in the unit automatic performance data indicates the pitch, the step time the time of tone generation, the gate time the length of the tone generation, and the velocity the strength of the tone generation. As special unit automatic performance data, 2-byte data including the end mark and step time is defined. This special unit automatic performance data indicates the end of a sequence of automatic performance data. This special unit automatic performance data having the end mark is stored at the end of automatic performance data corresponding to each of the performance patterns: intro, basic 1, basic 2, fill-in 1, fill-in 2 and ending.

While the key number and end mark are each defined at the first byte of unit automatic performance data, whether or not the first byte is a key number or an end mark is discriminated by checking if the MSB (Most Significant Bit) of the first byte is 0."

The basic 1 is a basic performance pattern of rhythms. The basic 1 corresponds to the first performance pattern in the automatic performance apparatus in one embodiment of the present invention.

The basic 2 is a performance pattern for executing a loud automatic performance containing a greater variety and higher volumes of timbres than the basic 1, and has the same rhythm as the basic 1. The basic 2 corresponds to the second performance pattern in the automatic performance apparatus in one embodiment of the present invention.

"Intro" is a performance pattern which is used to execute an automatic performance having a predetermined characteristic before the basic 1 performance starts. "Ending" is a performance pattern which is used to execute an automatic performance having a predetermined characteristic to end the basic 1 performance or basic 2 performance.

"Fill-in 1" is a performance pattern which is used to perform an automatic performance having a predetermined characteristic during the execution of the basic 2 performance. The fill-in 1 is also used to perform a predetermined automatic performance before proceeding to the basic 2 performance, when the variation switch 142 is depressed during the execution of the basic 1 performance. The fill-in 1 corresponds to the third performance pattern in the automatic performance apparatus in one embodiment the present invention.

"Fill-in 2" is a performance pattern which is used to perform an automatic performance having a predetermined characteristic during the execution of the basic 1 performance. The fill-in 2 is also used to perform a predetermined automatic performance before proceeding to the basic 1 performance, when the variation switch 142 is depressed during the execution of the basic 2 performance. The fill-in 2 corresponds to the fourth performance pattern in the automatic performance apparatus in one embodiment the present invention.

The wave memory 18 stores waveform data. The wave memory 18 may be a ROM. Waveform data may be prepared by converting a generated musical tone into an electric signal and then subjecting the electric signal to pulse code modulation (PCM). Stored in the wave memory 18 are plural types of waveform data corresponding to a plurality of timbres. Even with a single timbre, plural pieces of waveform data may be prepared in accordance with a given range. The waveform data stored in the wave memory 18 is read out via the system bus 30 by the tone generator 19.

The tone generator 19 has a plurality of oscillators, for example. Upon reception of a timbre parameter and a tone ON instruction from the CPU 10, a selected oscillator in the tone generator 19 obtains waveform data from the wave memory 18, affixes an envelope to this waveform data to yield a digital tone signal, and sends the digital tone signal to the D/A converter 20. In response to a tone OFF instruction from the CPU 10, the oscillator stops reading out waveform data from the wave memory 18 and stops sending the associated digital tone signal to the D/A converter 20.

The D/A converter 20 converts the digital tone signal from the tone generator 19 into an analog tone signal. The output of the D/A converter 20 is supplied to the amplifier 21. The amplifier 21 amplifies the received analog tone signal by a given amplification factor. The amplified tone analog tone signal is supplied to the loudspeaker 22. The loudspeaker 22 is of a known type which converts the analog tone signal as an electric signal into an acoustic signal.

The characteristic operation of the embodiment of the present invention will now be described with reference to a timing chart given in FIG. 4.

Figure 4:
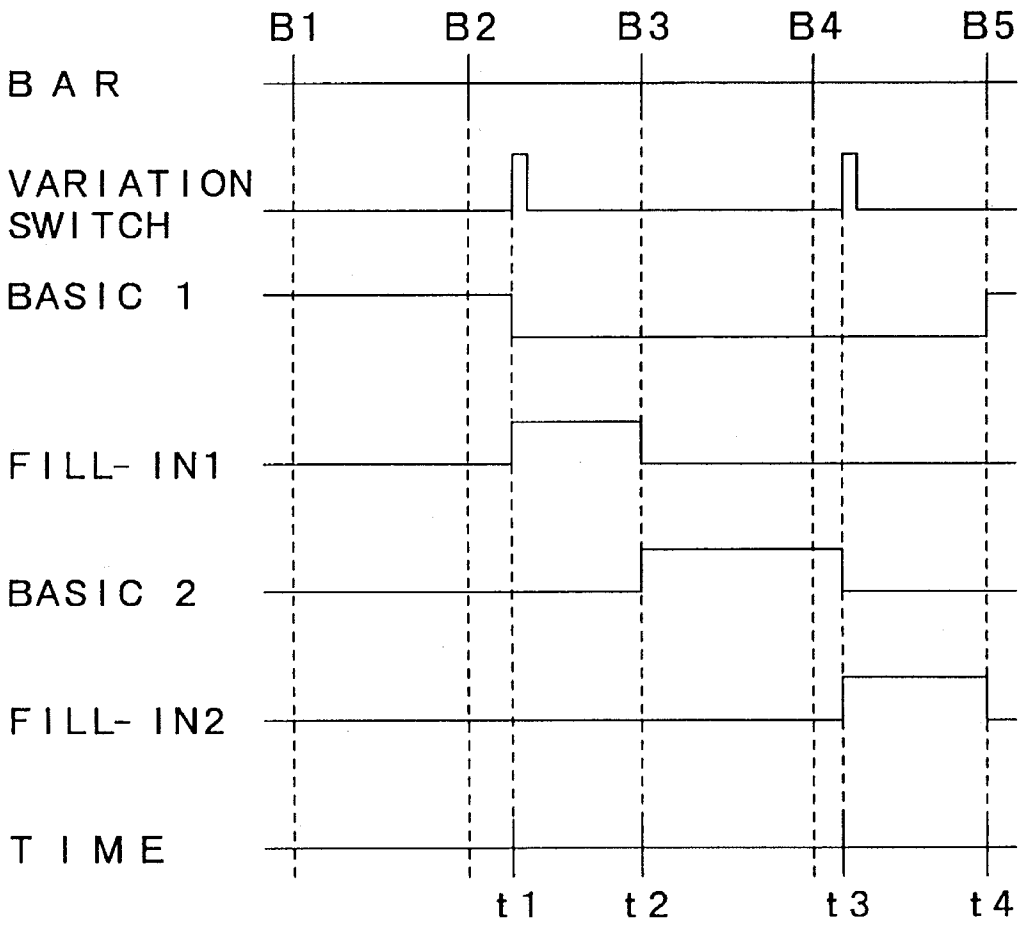
FIG. 4 is a timing chart for explaining the characterizing operation of the automatic performance apparatus of the present invention.

FIG. 4 shows a plurality of bars, B1 to B5, which are automatically performed. The basic 1 performance is executed in the bar B1 and continues until the variation switch 142 is depressed in the bar B2. When the variation switch 142 is depressed at time t1 in the bar B2, the basic 1 performance is stopped and an automatic performance with the fill-in 1 starts.

In this case, the automatic performance with the fill-in 1 is controlled to be terminated at the end of the bar B2 (time t2). Although this embodiment is designed such that the fill-in 1 performance starts immediately after the fill-in switch 143 is depressed, it may be designed so that the fill-in 1 performance is executed from the next bar to the bar in which the fill-in switch 143 has been depressed. This embodiment may be designed in such a manner that when the depression of the fill-in switch 143 is located in the first half of a bar, the fill-in 1 performance starts immediately, but when the depression of the fill-in switch 143 is located in the second half of that bar, the fill-in 1 performance is executed from the next bar. The length of the fill-in 1 performance is not limited to be within one bar, but may be as long as two bars (to the end of the bar B3) or may be longer. When this fill-in 1 performance ends, the basic 2 performance starts from the beginning of the bar B3.

As described above, the fill-in 1 performance is automatically inserted at the time of transition from the normal automatic performance with the basic 1 to the automatic performance for climax with the basic 2, so that the awkward or unnatural feeling at the time of transition from the basic 1 performance to the basic 2 performance is suppressed, thus providing smoother transition.

A similar process is carried out for the transition from the basic 2 performance to the basic 1 performance. The basic 2 performance is executed in the bar B3 and continues until the variation switch 142 is depressed in the bar B4. When the variation switch 142 is depressed at time t3 in the bar B4, the automatic performance with the basic 2 is stopped and an automatic performance with the fill-in 2 starts.

In this case, the automatic performance with the fill-in 2 is controlled to be terminated at the end of the bar B4 (time t4). In this case, the timing at which the fill-in 2 performance starts and the length of the fill-in 2 performance can be arbitrarily determined as discussed above. When this fill-in 2 performance ends, the basic 1 performance starts from the beginning of the bar B5.

As described above, the fill-in 2 performance is automatically inserted at the time of transition from the automatic performance for climax with the basic 2 to the normal automatic performance with the basic 1, so that the unnatural feeling at the time of transition from the basic 2 performance to the basic 1 performance is suppressed, thus providing smoother transition.

An operation to accomplish the above-described characteristic function of the embodiment of the present invention will now be described with reference to flowcharts given in FIGS. 5 through 10.

Figure 5:
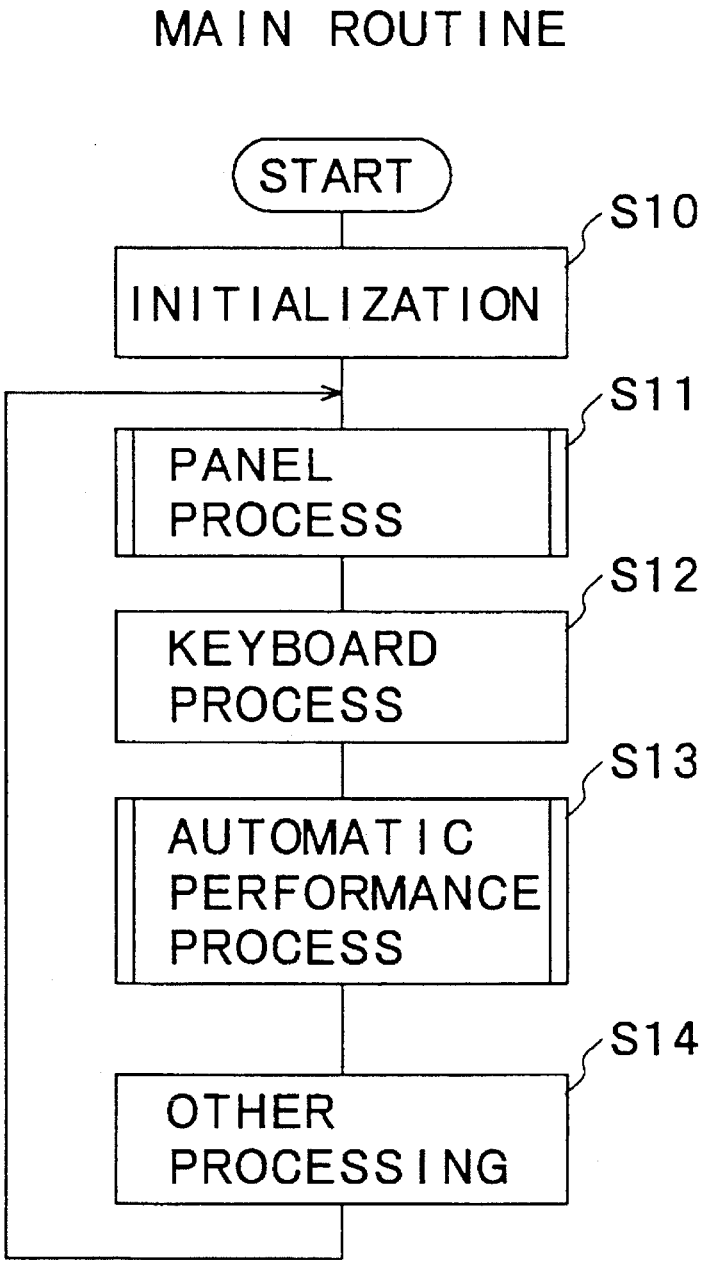
FIG. 5 is a flowchart (main routine) illustrating the operation of the embodiment of the present invention.
Figure 6:
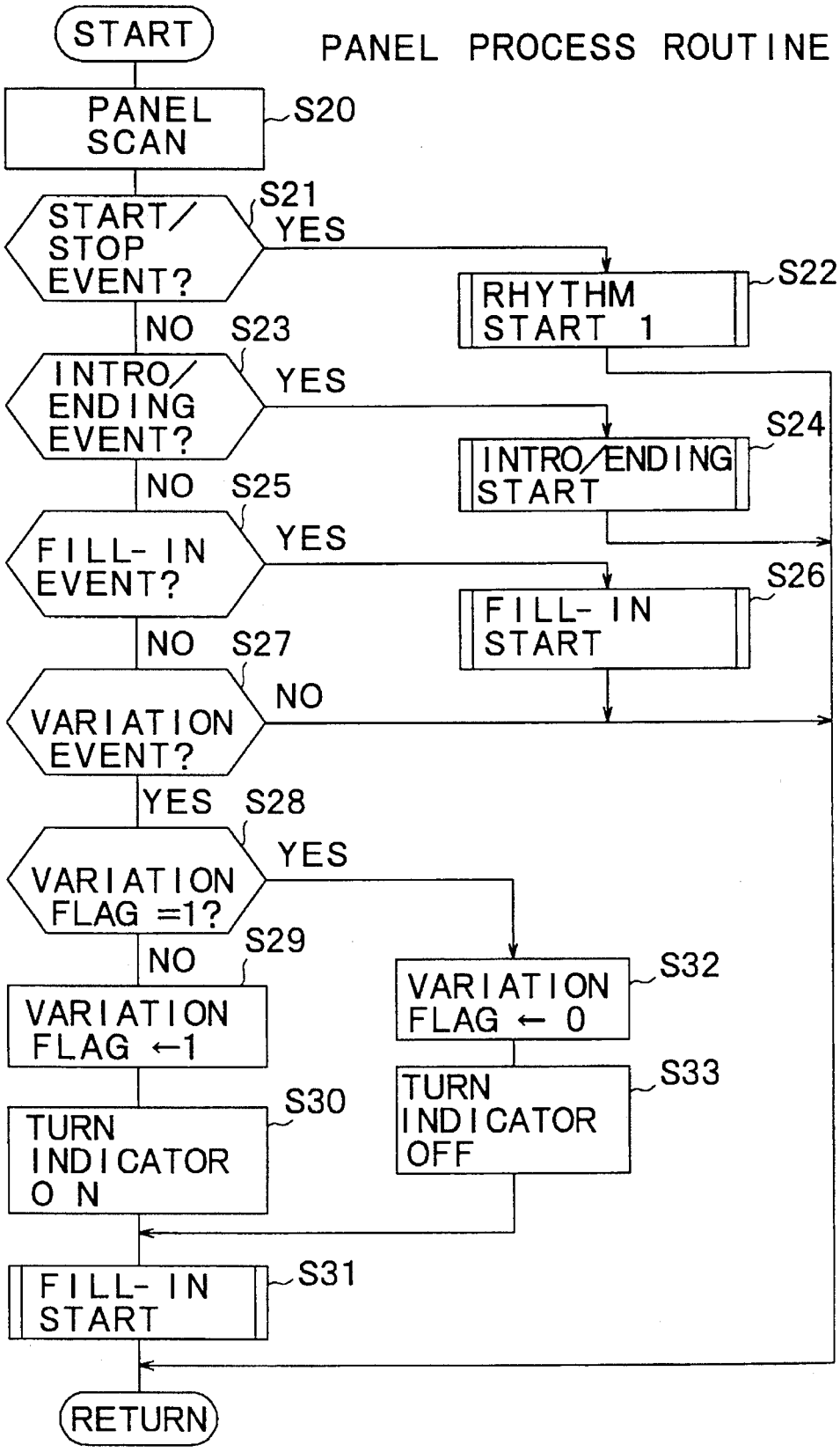
FIG. 6 is a flowchart (panel process routine) illustrating the operation of the embodiment of the present invention.

FIG. 5 presents the flowchart which shows the main routine of this electronic musical instrument. This main routine is invoked when the electronic musical instrument is powered on. Upon power on, initialization is executed first (step S10). In this initialization, the registers and flags in the CPU 10 are cleared, initial values are set to the registers, counters, flags and the like defined in the RAM 12, and a predetermined data is set to the tone generator 19 to suppress the generation of undesired tones.

Then, a panel process is performed (step S11). In this panel process, the CPU 10 receives panel data from the control panel 14 and performs a process according to the operation of each switch. Predetermined data is sent to the indicator 144 to turn on or off the indicator 144. The details of this panel process will be given later.

Next, a keyboard process is executed (step S12). In this keyboard process, a tone-ON process associated with the depression of a key or tone-OFF process associated with the release of a key is carried out. This keyboard process will be discussed briefly below. In the keyboard process, it is first checked if there is any key event. This check is executed in the following manner. First, key data including a sequence of bits indicating the ON/OFF status of the individual keys (hereinafter called "new key data") and velocity data are supplied from the keyboard interface circuit 15 via the system bus 30.

Then, the new key data is compared with key data, which has previously been obtained in the above-described manner and has already been stored in the RAM 12 (hereinafter called "old key data"), and a key event map with the bit corresponding to every unmatched bit being set on is prepared. The occurrence or absence of a key event is determined by checking if there is any ON-state bit in this key event map. When the occurrence of a key even is determined by referring to the key event map, it is then checked if that event is a key depression event. This is accomplished by checking if the bit in new key data, which corresponds to the ON-status bit in the key event map, is set on.

When the key depression event is determined, a tone-ON process is performed. In this tone-ON process, first, a specific oscillator in the tone generator 19 is assigned for tone generation. Then, a timbre parameter is selected on the basis of the key number and velocity data of the ON-event key and on the basis of the timbre selected then (stored as a timbre number in a predetermined area in the RAM), etc. More specifically, one timbre parameter is read out from the program memory 11 and is sent to the oscillator which is assigned for tone generation. Consequently, the assigned oscillator in the tone generator 19 produces a digital tone signal based on the timbre parameter, and sends the digital tone signal to the D/A converter 20. The D/A converter 20 converts the digital tone signal into an analog tone signal, which is in turn sent to the amplifier 21. The amplifier 21 amplifies the analog tone signal by a given amplification factor, and sends the amplified tone signal to the loudspeaker 22. As a result, the loudspeaker 22 generates a musical tone according to the tone signal.

When the occurrence of a key release event is determined, on the other hand, a tone-OFF process is executed. More specifically, the oscillator in the tone generator 19 which is assigned to the OFF-event key is detected and a predetermined data is sent to this oscillator. Consequently, the tone generation associated with the released key stops. When this keyboard process is terminated, an automatic performance process is then executed (step S13). In this automatic performance process, tones for an automatic performance are generated based on the automatic performance data stored in the automatic performance data memory 17. The details of this automatic performance process will be given later.

When the automatic performance process is completed, other processing is executed (step S14). This "other processing" includes a process for transmission and reception of MIDI data via an unillustrated MIDI interface circuit, for example. Thereafter, the flow returns to step S11 to repeat the above-described sequence of processes.

When an event originated from the panel operation or the keyboard operation occurs during the repetitive execution of steps S11 to S14 in the main routine, the process associated with that event is carried out. In this manner, the individual functions of the electronic musical instrument or the automatic performance apparatus are accomplished.

The details of the panel process will now be given with reference to the flowcharts given in FIGS. 6 through 9. This panel process routine is called at every given period from the main routine.

In the panel process, first, a panel scan is executed (step S20) in the following manner. To begin with, panel data indicating the ON/OFF status of the individual switches (this data is hereinafter called "new panel data") is sent from the control panel 14 via the panel interface circuit 13 and system bus 30.

Then, the new panel data is compared with panel data which has previously been obtained in the same manner as discussed above and has already been stored in the RAM 12 (hereinafter called "old panel data"), and a panel event map with the bit corresponding to any unmatched bit being set on is prepared. The presence or absence of an ON-state bit is determined by checking if there is an ON-sate bit in the panel event map.

It is then checked if there is an event associated with the start/stop switch 141 (step S21). This is accomplished by checking if the bit in the panel event map which corresponds to the start/stop switch 141 is set on. When the ON event of the start/stop switch 141 is determined, a rhythm start 1 process is performed (step S22). Thereafter, the flow returns to the main routine from the panel process routine. The details of the rhythm start 1 process are illustrated in the flowchart in FIG. 7.

Figure 7:
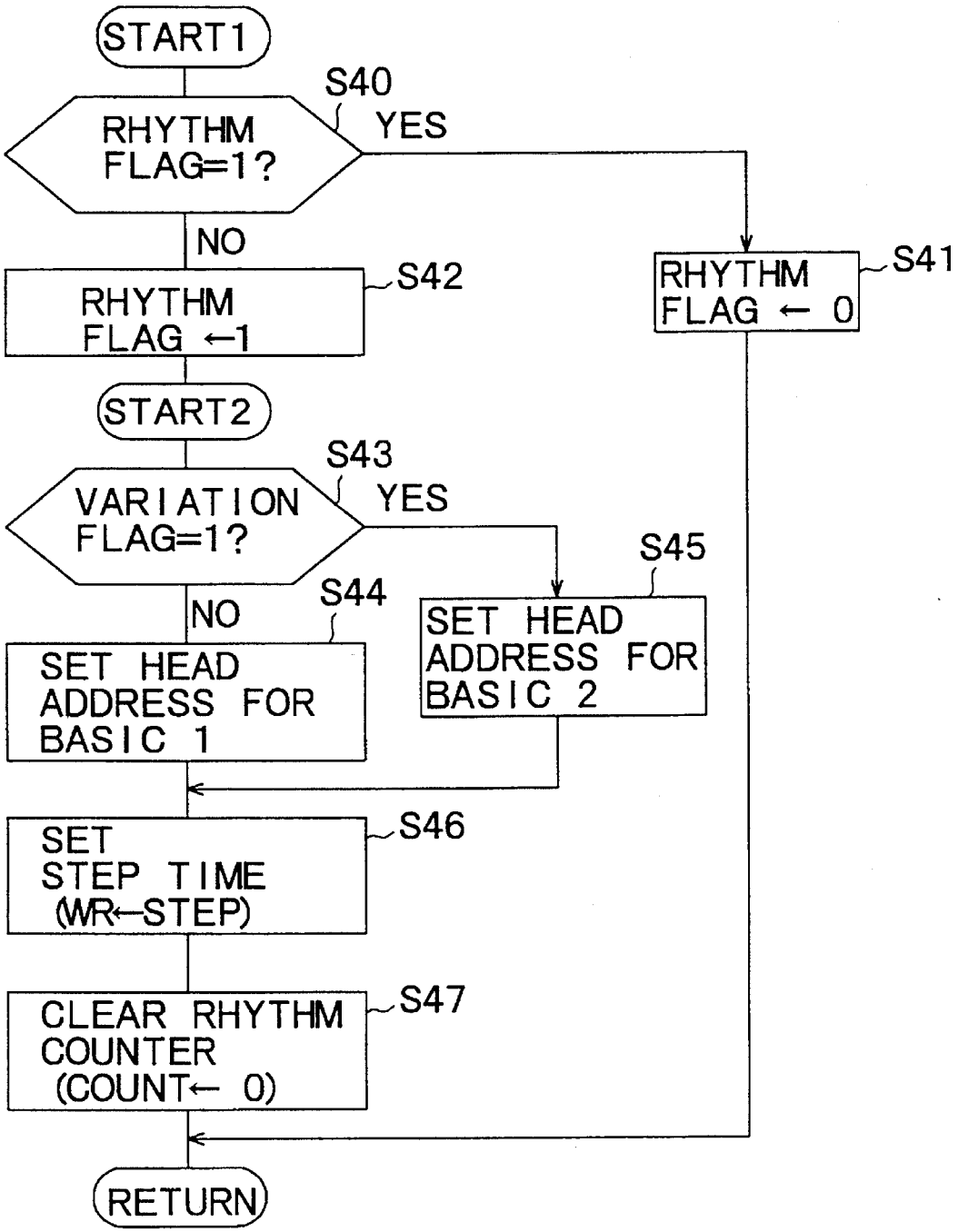
FIG. 7 is a flowchart (rhythm start process routine) illustrating the operation of the embodiment of the present invention.
Figure 8:
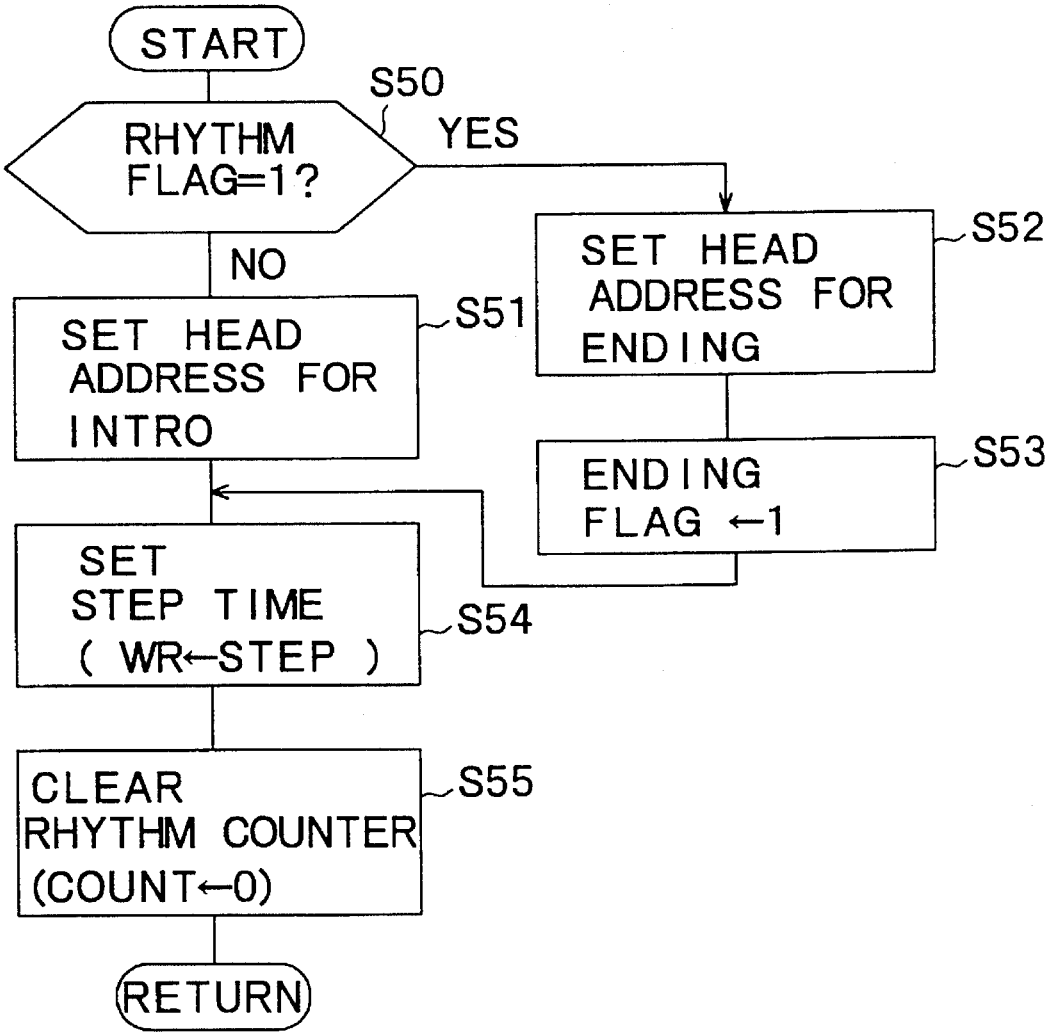
FIG. 8 is a flowchart (intro/ending start process routine) illustrating the operation of the embodiment of the present invention.
Figure 9:
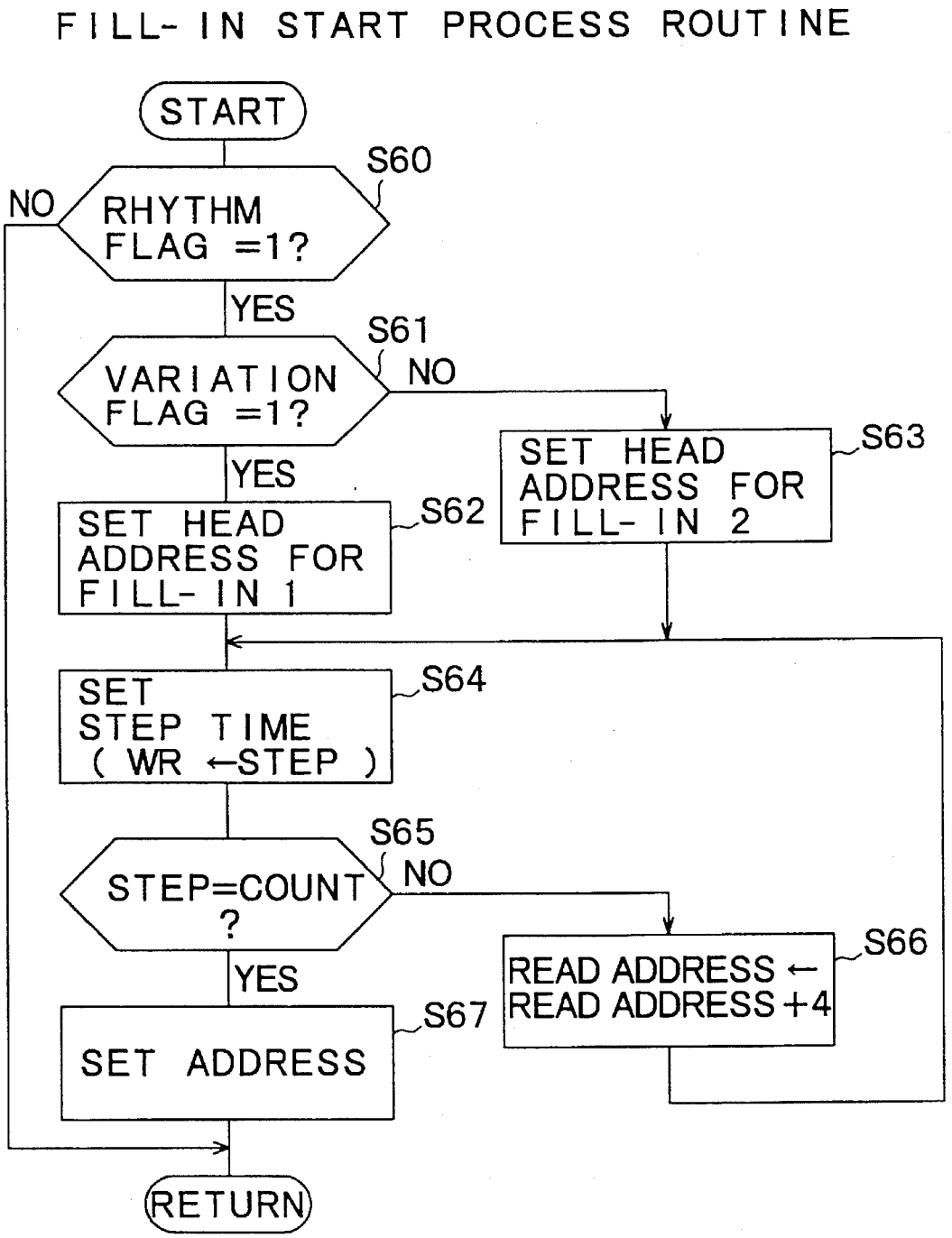
FIG. 9 is a flowchart (fill-in start process routine) illustrating the operation of the embodiment of the present invention.

The rhythm start process 1 starts from "start 1" in the flowchart in FIG. 7. First, it is checked if a rhythm flag is "1" (step S40). The rhythm flag, which is provided in the RAM 12, indicates whether or not this electronic musical instrument is executing an automatic performance.

When it is determined that the rhythm flag is "1" and an automatic performance is being performed, the rhythm flag is cleared to "0" (step S41). This provides a function for stopping an automatic performance when the start/stop switch 141 is depressed during the execution of the automatic performance. When it is determined that the rhythm flag is not "1" and an automatic performance is not performed, the rhythm flag is set to "1" (step S42). This provides a function for starting an automatic performance when the start/stop switch 141 is depressed while no automatic performance is being performed. The steps S40 to S42 achieve a toggle function for repeating the alternate start and stop of an automatic performance every time the start/stop switch 141 is depressed.

Next, it is checked if a variation flag is "1" (step S43). The variation flag, provided in the RAM 12, indicates the depression status of the variation switch 142, i.e., it indicates whether the basic 1 performance or the basic 2 performance is to be performed. This variation flag is set or cleared in accordance with the event of the variation switch 142.

When it is determined that the variation flag is "0" indicating that the basic 1 performance should be executed, the head address of automatic performance data (address in the automatic performance data memory 17; the same applies in the following description), which corresponds to the basic 1 performance with a rhythm (stored as a rhythm number in a predetermined area in the RAM) selected then, is set in an address register provided in the RAM 12 (step S44). When it is determined that the variation flag is "1" indicating that the basic 2 performance should be executed, the head address of automatic performance data corresponding to the basic 2 performance with a rhythm selected then, is set in the address register (step S45). Accordingly, automatic performance data is sequentially read out from the location specified by the address set in the address register, and the basic I performance or the basic 2 performance is executed in an automatic performance process routine to be described later.

The step time in the first unit automatic performance data is read out from the position specified by the address set in the address register and is set in a work register WR (step S46). The work register WR is provided in the RAM 12.

Then, a rhythm counter is cleared (step S47). The rhythm counter, which is provided in the RAM 12 for example, is used to manage the progression of the rhythm. This rhythm counter may be constituted by a hardware counter. The rhythm of the automatic performance progresses thereafter in synchronism with the content COUNT of this rhythm counter. Thereafter, the flow returns to the panel process routine from this rhythm start process routine, and then returns to the main routine from the panel process routine.

If it is determined in step S21 in the panel process routine that there is no event of the start/stop switch 141, it is then checked if there is an event associated with the intro/ending switch 140 (step S23). This check is accomplished by checking if a bit in the panel event map which corresponds to the intro/ending switch 140 is set on.

When it is determined that there is an event of the intro/ending switch 140, an intro/ending start process is executed (step S24), after which the flow returns to the main routine from the panel process routine. The details of the intro/ending start process are illustrated in the flowchart in FIG. 8.

In the intro/ending start process, it is first checked if the rhythm flag is "1", that is, if an automatic performance is being performed (step S50). When it is determined that the rhythm flag is not "1", i.e., that the intro/ending switch 140 has been depressed while no automatic performance is performed, the head address of intro performance data with a rhythm selected then is set in the address register (step S51). Accordingly, automatic performance data is sequentially read out from the location specified by the address set in the address register and the intro performance is executed in the automatic performance process routine which will be described later.

When it is determined that the rhythm flag is "1", i.e., that the intro/ending switch 140 has been depressed during the execution of an automatic performance, the head address of ending performance data with a rhythm selected then is set in the address register (step S52). Then, an ending flag is set to "1" (step S53). The ending flag, provided in the RAM 12, indicates whether or not to perform an ending performance. After step S53, the flow advances to step S54. Accordingly, automatic performance data is sequentially read out from the location specified by the address set in the address register and the ending performance is executed in the automatic performance process routine which will be described later. As the ending flag is set to "1", the automatic performance stops when the ending performance is completed.

In step S54, the step time in the first unit automatic performance data is read out from the position specified by the address set in the address register and is set in the work register WR. Then, the rhythm counter is cleared (step S55). Thereafter, the flow returns to the panel process routine from this intro/ending start process routine, and then returns to the main routine from the panel process routine.

If it is determined in step S23 in the panel process routine that there is no event of the intro/ending switch 140, it is then checked if there is an event associated with the fill-in switch 143 (step S25). This check is accomplished by checking if a bit in the panel event map which corresponds to the fill-in switch 143 is set on.

When it is determined that there is an event of the fill-in switch 143, a fill-in start process is executed (step S26), after which the flow returns to the main routine from the panel process routine. The details of the fill-in start process are illustrated in the flowchart in FIG. 9.

In the fill-in start process, it is first checked if the rhythm flag is "1", that is, if the execution of an automatic performance is in progress (step S60). When it is determined that the rhythm flag is not "1", i.e., that the fill-in switch 143 has been depressed while no automatic performance is in progress, the flow returns to the panel process routine from this fill-in start process routine without performing the subsequent processing, and then returns to the main routine from the panel process routine. That is, the fill-in switch 143 is invalid when no automatic performance is in progress.

When it is determined that the rhythm flag is "1", i.e., that the fill-in switch 143 has been depressed during the execution of an automatic performance, it is checked if the variation flag is "1" (step S61). When it is determined that the variation flag is "1" which means that the automatic performance with the basic 2 is currently performed, the head address of automatic performance data for the fill-in 1 with a rhythm selected then is set in the address register (step S62).

When it is determined that the rhythm flag is not "1", which means that an automatic performance with the basic 1 is currently performed, the head address of automatic performance data for the fill-in 2 with a rhythm selected then is set in the address register (step S63).

Next, the step time in the first unit automatic performance data is read out from the location specified by the address set in the address register and is set in the work register WR (step S64). Then, the step time STEP set in the work register WR is compared with the content COUNT of the rhythm counter. When there is no match, the read-out address of the automatic performance data is incremented by "+4" (step S66) after which the flow returns to step S64. The loop of the steps S64, S65 and S66 is repeated until the step time STEP coincides with the content COUNT of the rhythm counter. This is a process for skipping automatic performance data to the one having the step time matching with the content COUNT of the rhythm counter at the time the fill-in switch 143 is depressed in a middle of a bar. Even the fill-in switch 143 is depressed at any timing, the rhythm will not be asynchronous.

When it is determined in step S65 in the aforementioned loop that the step time STEP matches with the content COUNT of the rhythm counter, the read-out address at that time is set in the address register (step S67). Accordingly, automatic performance data is sequentially read out from the location specified by the address set in the address register and the automatic performance with the fill-in 1 or fill-in 2 is executed in the automatic performance process routine which will be discussed later. Thereafter, the flow returns to the panel process routine from this fill-in start process routine, and then returns to the main routine from the panel process routine.

When it is determined in step S25 in the panel process routine that there is no event of the fill-in switch 143, it is then checked if there is an event associated with the variation switch 142 (step S27). This check is accomplished by checking if a bit in the panel event map which corresponds to the variation switch 142 is set on. If it is determined that there is no event of the variation switch 142, the flow returns to the main routine from the panel process routine.

When it is determined that there is an event associated with the variation switch 142, it is then checked if the variation flag is "1" (step S28). When it is determined that the variation flag is "1" which means that the basic 2 performance is in progress, the variation flag is reset to "0" (step S32). Then, the indicator 144 is turned off (step S33) by sending a predetermined data via the panel interface circuit 13 to the control panel 14 from the CPU 10. In the fill-in start process (step S31), if an automatic performance is in progress, that is, the rhythm flag is "1", the fill-in 2 performance starts. And when an end of the fill-in 2 performance is determined in a step S78 of an automatic performance process which will be discussed later, a rhythm start 2 process (step S79) is executed and then the basic 1 performance starts. On the other hand, in the fill-in start process (step S31), if no automatic performance is in progress, that is, the rhythm flag is "0", no performance is executed. In this case, the basic 1 performance will start when the start/stop switch 141 is depressed.

When it is determined in the step S28 that the variation flag is not "1" which means that the basic 1 performance is in progress, the variation flag is set to "1" (step S29). Then, the indicator 144 is turned on (step S30) by sending predetermined data via the panel interface circuit 13 to the control panel 14 from the CPU 10. In the fill-in start process (step S31), if an automatic performance is in progress, that is, the rhythm flag is "1", the fill-in 1 performance starts. And when an end of the fill-in 1 performance is determined in a step S78 of an automatic performance process, the rhythm start 2 process (step S79) is executed and then the basic 2 performance starts. On the other hand, in the fill-in start process (step S31), if no automatic performance is in progress, that is, the rhythm flag is "0", no performance is executed. In this case, the basic 2 performance will start when the start/stop switch 141 is depressed.

The steps S28, S29 and S32 achieve a toggle function for alternately switching the basic 1 performance and basic 2 performance from one to another through the fill-in 1 performance or fill-in 2 performance every time the variation switch 142 is depressed while the execution of an automatic performance is in progress. On the other hand, the instruction of the basic 1 performance and the basic 2 performance is alternately changed from one to another every time the variation switch 142 is depressed while no automatic performance is in progress.

Then, the fill-in start process is executed (step S31). This fill-in start process is the same as the one performed in the step S26. Accordingly, while the execution of an automatic performance is in progress, automatic performance data is sequentially read out from the location specified by the address set in the address register in the fill-in start process, and the fill-in 1 performance or the fill-in 2 performance is executed in the automatic performance process routine which will be discussed later. Thereafter, the flow returns to the main routine from this panel process routine. On the other hand, while no automatic performance is in progress, the flow returns from panel process routine to the main routine without any processing.

Through the above-described panel process, it is determined whether an automatic performance with some automatic performance data should be started or the current automatic performance should be stopped in accordance with the switch operation on the control panel 14, and an automatic performance is executed through predetermined processing in the automatic performance process routine which will be discussed below.

Figure 10:
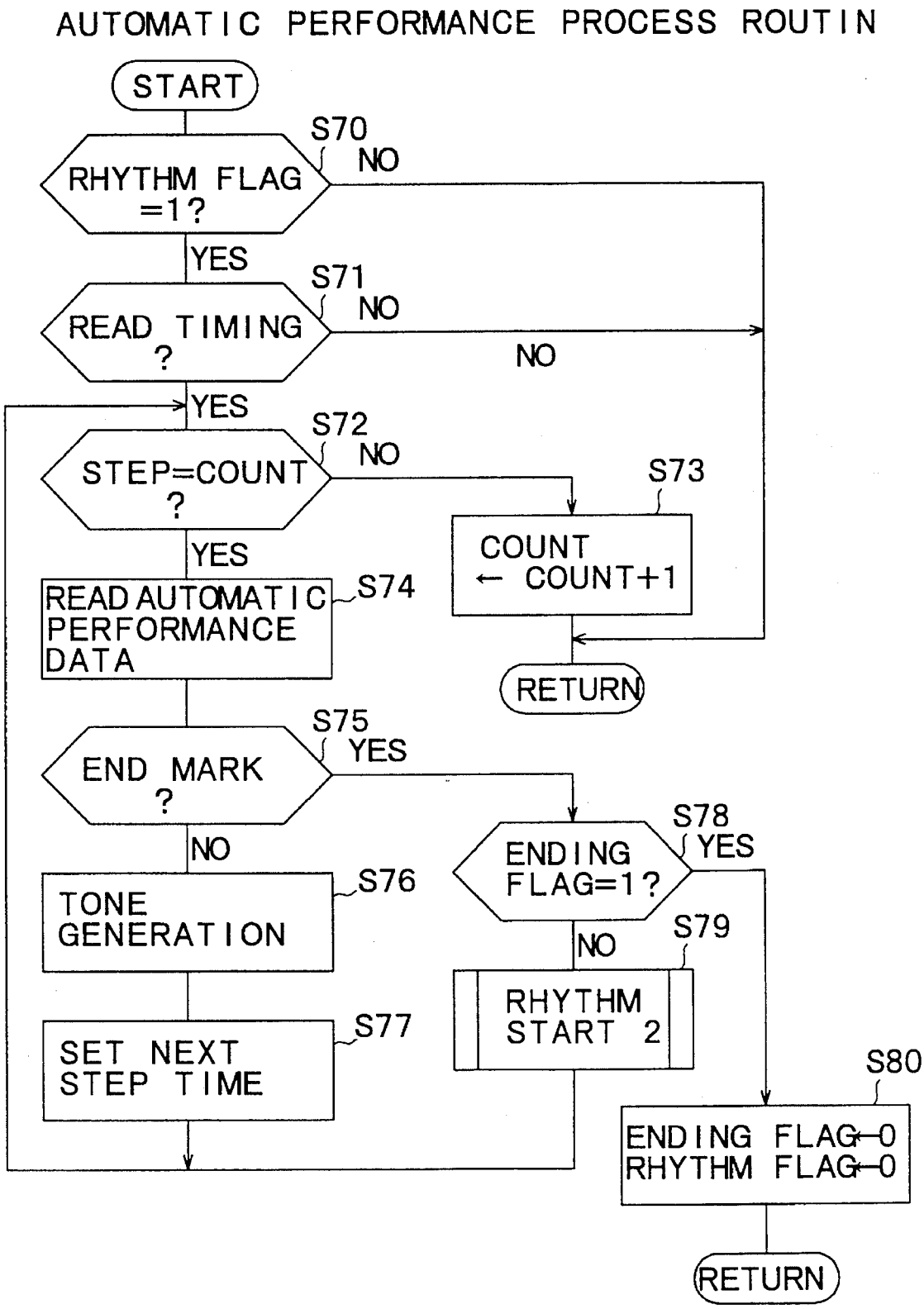
FIG. 10 is a flowchart (automatic performance process routine) illustrating the operation of the embodiment of the present invention.

The details of the automatic performance process will now be discussed with reference to the flowchart given in FIG. 10. This automatic performance process routine is called at every given period from the main routine.

In the automatic performance process, it is first checked if the rhythm flag is "1" (step S70). When it is determined that the rhythm flag is not "1", i.e., that no automatic performance is currently in progress, the flow returns to the main routine from this automatic performance process routine without performing the subsequent processing. This provides a function to stop an automatic performance.

When it is determined that the rhythm flag is "1", which means that an automatic performance is currently in progress, it is checked if a readout timing for automatic performance data has arrived (step S71). The "readout timing" is the timing at which automatic performance data that arrives at every given period is read out. The readout timing may be set to 1/192 of the length of one bar. Whether or not the readout timing has arrived is determined by referring to the time measured by, for example, a clock mechanism (not shown). When it is determined in this step S71 that the readout timing has not arrived yet, the flow returns to the main routine from this automatic performance process routine without performing the subsequent processing.

When the arrival of the readout timing is determined in the step S71, the step time STEP set in the work register WR is compared with the content COUNT of the rhythm counter (step S72). When there is no match, it is considered that unit automatic performance data having the current step time STEP set in the work register WR is not ready for tone generation. In this case, the flow moves to step S73 to increment the content COUNT of the rhythm counter. Every time the readout timing arrives, e.g., every time a time equivalent to 1/192 of the length of one bar passes, the content COUNT of the rhythm counter is incremented. Thereafter, the flow returns to the main routine from the automatic performance process routine.

When the above comparison results in a match, unit automatic performance data (4 bytes) is read out from the location specified by the address set in the address register then (step S74). Next, it is checked if this unit automatic performance data indicates an end mark (step S75). This is accomplished by checking the MSB of the first byte in the unit automatic performance data. When it is not determined that the unit automatic performance data indicates an end mark, the tone-ON process is executed next (step S76).

In this tone-ON process, first, a specific oscillator in the tone generator 19 is assigned for tone generation. Then, a timbre parameter is selected on the basis of the key number, and velocity data in the unit automatic performance data and the timbre selected then (stored as a timbre number in a predetermined area in the RAM), etc. More specifically, one timbre parameter is read out from the program memory 11 and is sent to the oscillator which is assigned for tone generation. Consequently, the assigned oscillator in the tone generator 19 produces a digital tone signal based on the timbre parameter, and sends the digital tone signal to the D/A converter 20. The D/A converter 20 converts the digital tone signal into an analog tone signal, and sends the analog tone signal to the amplifier 21. The amplifier 21 amplifies the analog tone signal by a given amplification factor, and sends the amplified tone signal to the loudspeaker 22. As a result, the loudspeaker 22 generates a musical tone according to the tone signal.

Tone-OFF is carried out by detecting the oscillator whose gate time becomes zero and by sending predetermined data to that oscillator.

Then, the next unit automatic performance data is read out from the automatic performance data memory 17, and the step time is acquired from this unit automatic performance data and is set in the work register WR (step S77). Then, the flow returns to step S72 to repeat the above-described sequence of steps. As the sequential processing is repeated, unit automatic performance data is sequentially read out from the automatic performance data memory 17 and every unit automatic performance data that has the step time STEP matching with the content COUNT of the rhythm counter is sent to the tone generator 19. Accordingly, tone generation is executed based on every unit automatic performance data that has the step time STEP matching with the content COUNT of the rhythm counter.

When an end mark is determined in the step S75, on the other hand, it is checked if the ending flag is "1" (step S78). When it is determined that the ending flag is not "1", the rhythm 2 process is executed (step S79). This rhythm 2 process starts from "start 2" in the flowchart shown in FIG. 7. In this process, as has already been explained, an automatic performance with the basic 1 or basic 2 starts depending on the status of the variation flag then.

When the intro performance is terminated by the detection of an end mark, the basic 1 performance or basic 2 performance starts depending on the status of the variation flag then.

When the fill-in 1 performance or the fill-in 2 performance is terminated by the detection of an end mark, the basic 1 performance or the basic 2 performance starts depending on the status of the variation flag then. More specifically, when the variation flag is "1", which means that the fill-in 1 performance takes places by the depression of the variation switch 142 during the execution of the basic 1 performance or that the fill-in 1 performance takes places by the depression of the fill-in switch 143 during the execution of the basic 2 performance, the basic 2 performance starts in this case. Therefore, the transition from the basic 1 performance, to the fill-in 1 performance, then to the basic 2 performance is accomplished by the depression of the variation switch 142, or the transition from the basic 2 performance, to the fill-in 1 performance, then to the basic 2 performance is accomplished by the depression of the fill-in switch 143.

When the variation flag is "0" which means that the fill-in 2 performance takes places by the depression of the variation switch 142 during the execution of the basic 2 performance or that the fill-in 2 performance takes places by the depression of the fill-in switch 143 during the execution of the basic 1 performance, the basic 1 performance starts in this case. Therefore, the transition from the basic 2 performance, to the fill-in 2 performance, then to the basic 1 performance is accomplished by the depression of the variation switch 142, or the transition from the basic 1 performance, to the fill-in 2 performance, then to the basic 1 performance is accomplished by the depression of the fill-in switch 143.

When the basic 1 performance or the basic 2 performance is terminated by the detection of an end mark, the basic 1 performance or the basic 2 performance starts depending on the status of the variation flag then. More specifically, when the variation flag is "0" which means that the basic 1 performance has ended, the basic 1 performance is repeated thereafter. Likewise, when the variation flag is "1", which means that the basic 2 performance has ended, the basic 2 performance is repeated thereafter.

Although the above-described embodiment is designed in such a manner that the third performance pattern corresponds to the fill-in 1 and the fourth performance pattern corresponds to the fill-in 2, the third and fourth performance patterns may be constituted different performance patterns from the fill-in 1 and fill-in 2.

For instance, the third performance pattern may achieve an automatic performance that changes from the normal automatic performance to the climax performance, and the fourth performance pattern may achieve an automatic performance that changes from the climax performance to the normal automatic performance. And the fill-in 1 and fill-in 2 may performance patterns that provides the effect of an accent. This structure desirably widens the musical expression in an automatic performance.

As described in detail above, the present invention provides an automatic performance apparatus for an electronic musical instrument, which can permit a smooth transition from a predetermined performance pattern to another performance pattern with fewer control switches, without causing a player to feel awkward.

What is claimed is:

1. An automatic performance apparatus for an electronic musical instrument; comprising;

storage means for storing first automatic performance data for a automatic performance with a normal performance pattern, second automatic performance data for an automatic performance with a climax performance pattern, third automatic performance data for an automatic performance with a performance pattern which ensures a gradual transition from the automatic performance with the normal performance pattern to the automatic performance with the climax performance pattern, and fourth automatic performance data for an automatic performance with a performance pattern which ensures a gradual transition from the automatic performance with the climax performance pattern to the automatic performance with the normal performance pattern;

readout means for reading out said first to fourth automatic performance data from said storage means;

tone generating means for generating musical tones based on said first to fourth automatic performance data read out by said readout means;

single switching means for selecting the automatic performance with the normal performance pattern or the automatic performance with the climax performance pattern when no automatic performance is being performed, and switching between the automatic performance with the normal performance pattern and the automatic performance with the climax performance pattern when the automatic performance with the normal performance pattern or the automatic performance with the climax performance pattern is being performed;

start-instructing means for giving an instruction to start an automatic performance;

first control means for, when the instruction is given by said start-instructing means causing said readout means to read out the first automatic performance data with the normal performance pattern or the second automatic performance data with the climax performance pattern in accordance with the selection by said switching means; and second control means for causing said readout means to stop reading out the first automatic performance data, read out the third automatic performance data and then read out the second automatic performance data when said switching means is operated during an automatic performance with the normal performance pattern, or causing said readout means to stop reading out the second automatic performance data, read out the fourth automatic performance data and then read out the first automatic performance data when said switching means is operated during an automatic performance with the climax performance pattern.

2. The automatic performance apparatus according to claim 1, wherein said storage means is a read only memory.

3. The automatic performance apparatus according to claim 1, wherein said readout reads out the first or second automatic performance data repeatedly and reads out the third or fourth automatic performance data once.

* * * * *